US005466095A

United States Patent [19]

Scott

[11] Patent Number: 5,466,095

[45] Date of Patent: Nov. 14, 1995

[54] UNDERGROUND SUPPORT SYSTEM AND METHOD OF SUPPORT

[75] Inventor: James J. Scott, Phelps County, Mo.

[73] Assignee: Scott Investment Partners, Rolla, Mo.

[21] Appl. No.: 122,337

[22] Filed: Sep. 17, 1993

Related U.S. Application Data

[63] Continuation-in-part of Ser. No. 74,365, Jun. 10, 1993, abandoned.

[51] Int. Cl.[6] ..... E21D 21/00

[52] U.S. Cl. ..... 405/302.2; 405/259.1; 405/288

[58] Field of Search ..... 405/259.1, 259.4, 405/259.5, 259.6, 262, 288, 302.2, 302.3

[56] References Cited

U.S. PATENT DOCUMENTS

| | | | |
|---|---|---|---|
| 3,107,902 | 10/1963 | Calder | 405/302.3 X |
| 3,427,811 | 2/1969 | White | 61/45 |
| 3,509,726 | 5/1970 | White | 61/45 |
| 3,650,112 | 3/1972 | Howlett et al. | 405/259.5 |
| 4,265,571 | 5/1981 | Scott | 405/259 |
| 4,456,405 | 6/1984 | Galis | 405/288 |
| 4,634,318 | 1/1987 | Koumal | 405/302.2 |
| 4,666,344 | 5/1987 | Seegmiller | 405/259 |
| 4,699,547 | 10/1987 | Seegmiller | 405/288 |
| 4,749,310 | 6/1988 | White | 405/288 |
| 4,775,266 | 10/1988 | Seegmiller | 405/288 |
| 4,776,729 | 10/1988 | Seegmiller | 405/288 |
| 4,934,873 | 6/1990 | Calandra, Jr. | 405/288 |
| 5,018,907 | 5/1991 | Chugh et al. | 405/288 |
| 5,193,940 | 3/1993 | Long | 405/259 |
| 5,238,329 | 8/1993 | Long et al. | 405/288 |
| 5,259,703 | 11/1993 | Gillespie | 405/259.6 |

*Primary Examiner*—David H. Corbin

*Attorney, Agent, or Firm*—Polster, Lieder, Woodruff & Lucchesi

[57] ABSTRACT

A cable truss system for providing support for underground drifts in geologic structure in a first stage from anchor members secured in the geologic structure for leaving end portions in the drift to which a first system of supports are secured to engage on the geologic structure disturbed by the drift formation, and cable truss members connected to the first system of supports for establishing a second stage of support for the geologic structure disturbed by the drift formation.

2 Claims, 6 Drawing Sheets

UNDERGROUND SUPPORT SYSTEM AND METHOD OF SUPPORT

This application is a continuation-in-part of application Ser. No. 08/074,365 filed Jun. 10, 1993, now abandoned.

BACKGROUND OF THE INVENTION

The present invention is directed to underground support systems for resisting and preventing the dangers associated with the collapse of geologic structures in underground excavations such as drifts or passages in mining operations.

In the past many types of supports have been proposed to stabilize and improve the support of geologic formations when disturbed by excavating drifts or passages to reach desirable materials, the recovery of which is economical and in most cases important. Mechanical supports have been relied upon in regard to the structure that follows the most successful methods of gaining stability of geologic formations.

In recent times, mine support systems employing cables instead of rods have been used. Cables have been anchored in cementeous materials over long lengths in metal mines to stabilize geologic structures. Rock anchors of this type are normally passive in nature, not loading the rock but allowing the rock load to move to the anchor, but on occasion they are post tensioned with cable bodies attached to the cable with wedges and roof plates. In U.S. Pat. No. 4,265,571, there is disclosed a cable truss support system which has been effective in resisting geologic movements. This system employed long drive anchors in the form of friction stabilizers to place the cable and anchors in cementeous material and to provide a tension in the cable truss upon installation. In U.S. Pat. No. 3,509,726 of May 5, 1970, there is disclosed a method of rod support across the mine opening employing mechanical anchors or resinous anchors and using threaded turnbuckles to adjust roof support. In U.S. Pat. No. 3,427,811 of Feb. 18, 1969, there is disclosed a support system employing flexible cables. In this disclosure, rod elements are disposed in the boreholes in the mine roof and the exposed ends are interconnected by a flexible cable arrangement utilizing a turnbuckle device to produce tension. In. U.S. Pat. No. 3,601,994 of Aug. 31, 1971, there is disclosed a roof support system for underground drifts having a flexible cable arrangement in which the opposite ends of the cables were anchored by wedge members exerting restrictive contact on the surface of the boreholes after the wedge members are driven home to apply desired tension on the cables. Others in this field have developed rod/truss systems using threaded rods extended across the roof which are refinements of the above described techniques.

SUMMARY OF THE INVENTION

It is the principle object of the present invention to incorporate a flexible cable truss system with attachment mechanisms which will serve to anchor the cable trusses and provide a positive contact with the rock and the geologic mass to be supported. In addition, it is an additional object to improve the speed of installation and the utility of the cable truss system by using wedge locked cable bodies in conjunction with roof plates to provide a quick assembly system for the cable truss.

It is a further object of the present invention to use cable roof bolts as an integral part of the cable truss system. The cable bolts will hold roof plates securely to the roof and will allow for a secondary placement of horizontal cables across the drift opening. After a pair of roof plates and cable bolts are installed, the connecting cable member may be put in place and post tensioned by mechanical or hydraulic means to the desired active load for the cable trusses.

It is a further object of the invention to anchor cables in resinous or cementeous material at the base of a borehole by spinning the cable to assure mixing of the resinous components. Also, holes can be drilled of various diameters to meet field requirements, say, from one inch up to two inches in diameter. Mixing systems and compactor systems for the resinous material are provided to obtain assured anchorage under all geologic conditions.

Another object of the invention is to provide a plurality of methods for placement of the post tensioned cable truss. For example, plates may be placed by using standard cable bolts for attaching the plates to the geologic structure. A secondary step of placing the connecting cable through the bodies and securing the same followed by tensioning can be undertaken. In other cases, straight cables with no cable attachment device may be anchored in the cementeous or resinous material with the stub ends protruding from the roof. A secondary operation would be to place the plates against the geologic structure for securing them with an attached body and wedges to the protruding cables, followed by the placement of connecting cable members under post tensioning. The exact method to be employed would be determined by the geologic setting, the desire of the mine operator to fit the scheduling of cable truss placement into his production plan. For example, the anchor components, anchor cable bolts and plates could be placed at a different time allowing some little time to pass before the connecting cable members are placed and post tensioned. Such a system will serve to eliminate congestion in the working face and improve productivity.

Another object of this invention is to provide a plate system which will bend and form to the geologic surface it is placed against so that plate bending releases stress concentration in the connection points of the rock anchor and the cables. Also, flexing of the plate is particularly desirable when a plurality of cable blocks are attached to one plate serving as a junction point for several cables to be tensioned in various directions.

Another object is to provide a structural member in the form of a tensioned anchored cable to secure timber lagging or other forms of shoring to fill voids between the cable and the geologic material to restrain and limit geologic movement. The shoring can be placed and wedged after the cable is tensioned or may be set in place before cable tensioning and the cable tensioning will tighten the shoring against the geologic mass insuring load transfer.

Another object of the invention is to place tensioned cables over the surface of geologic material in such a manner that contact is made between the rock and the cable at projections of the rock to produce thrust vectors from the tensioned cable through the rock towards a common epicenter or centerline within the geologic mass. Ideally, if the cable can be tensioned in the shape of a parabolic curve all thrust vectors will be directed toward a center or a common point and maximum stabilizing effect can be obtained.

The broad scope of this present invention is directed to post tensioned cable trusses made up of flexible cable, plates bendably responsive to surface formations, cable bodies and wedges having the end portion secured in the geologic mass of the roof, sides, pillars, or other places where mining or underground operations or the construction of opening earth are to be found. Normally, a plurality of cable trusses are employed or required. They generally have common features. A typical cable truss support means for geologic mass comprises means for positioning the terminal end portions of the cable truss in the geologic mass so that upon exerting tension upon the cable truss to provide the intended support, a high degree of anchorage in the mass can be developed and a substantial, stable support system will result. The means for exerting tension in the cable truss takes a form of the connecting cable member being hydraulically stretched to provide tension in the horizontal member and in turn tension the cable anchors in the geologic material so that load can be adjusted to fit geologic conditions which may be encountered through normal strain of the geologic mass.

The present invention may be embodied in variations of the foregoing, all of which will be set forth in greater detail in the following description which is directed to components in which the roof plates, cable sections, cable bodies, wedges, and tensioning mechanisms are all integrated to produce a cable truss giving the desired characteristics.

BRIEF DESCRIPTION OF THE DRAWINGS

The foregoing and other features of the invention will become evident from a consideration of the following disclosure in the drawings, wherein.

DETAIL DESCRIPTION OF THE INVENTION

Figure 1:
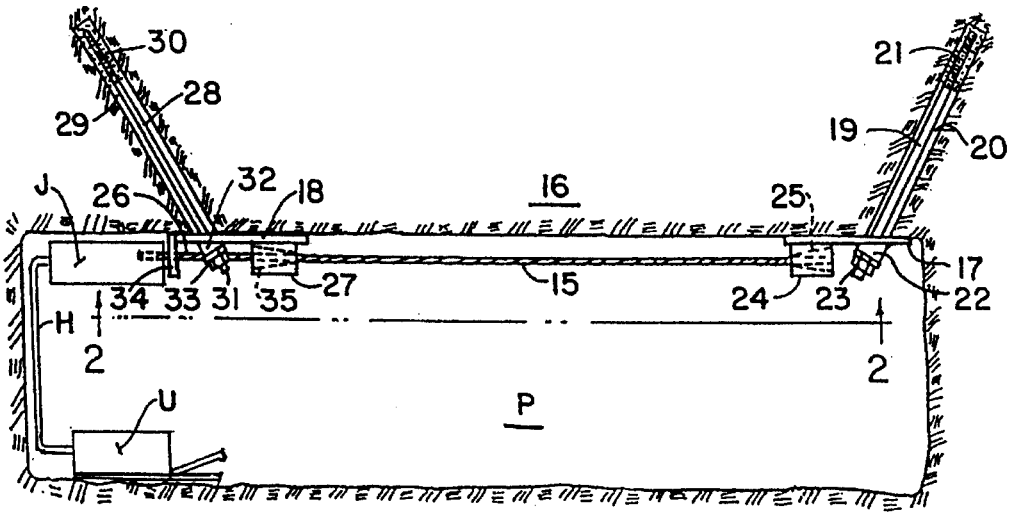
FIG. 1 is one arrangement of a truss system installed in a drift or passage according to the invention.

In the disclosure of FIG. 1 there is shown a flexible cable 15 stretched along a geologic structure 16 between support plates 17 and 18 which secure the end portions of the cable 15. One support plate 17 is retained against the geologic structure 16 by an anchor bolt 19 held in a borehole 20 by a body of grout or settable resin 21 at the back of the borehole 20. That support plate is formed with a socket 22 which receives the threaded protruding end of the anchor bolt 19 which is engaged by a threaded nut 23. Also the support plate 17 carries a ferrule 24 which receives the end of the cable and is secured therein by suitable tapered wedges 25. The opposite end 26 of the cable 15 is anchored in a ferrule 27 on the second support plate 18. That plate 18 is held by an anchor bolt 28 secured in a borehole 29 by grout or settable resin 30 in the end of the borehole. The protruding end 31 of the anchor bolt 28 is secured in a socket 32 by a threaded on nut 33. In this end support 18 there is a strut 34 which is formed with an aperture to receive the cable end 26 and provide an abutment for a suitable cable jack device which may be a fluid pressure tensioning jack (Model BLM MINCON) operated in response to a power unit U. The jack J is connected by a suitable hose system H from the power unit U. The jack J is capable of exerting a predetermined desired tension load on the cable 15 of several tons. After the tension load is reached, wedges 35 are inserted in the ferrule to retain the cable at the desired tension load.

Figure 2A:
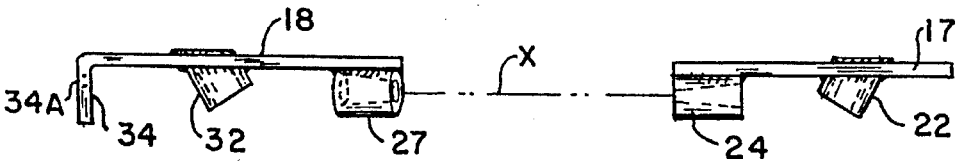
FIG. 2A is a side elevation of the anchor plate of FIG. 2.
Figure 2:
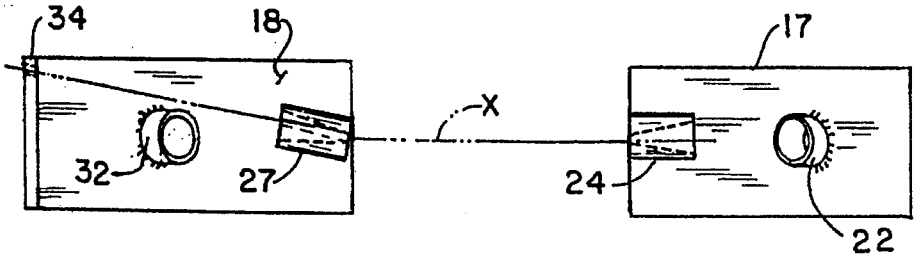
FIG. 2 is a view of the anchor plate details of the truss system seen in FIG. 1 as viewed along line 2—2.

Turning to FIGS. 2 and 2A it is seen that the support plates 17 and 18 are in alignment with each other, and are selected from flexible material that is capable of yielding or bending to conform to the surfaces of the rock against which they are placed. Sockets 22 and 32 on the respective plates 17 and 18 are directed at an angle to match the angular positions of the respective anchor bolts 19 and 28. In addition the ferrule 24 on support plate 17 has its axis in alignment with the sockets 22 and 32. However, the ferrule 27 has its axis turned at an angle of about ten degrees to the alignment sighting line X so that the cable end portion can be directed into the aperture 34A in the strut 34 so that the jacking device can impart its tension load on the cable. Once the cable 15 has been tensioned wedges 35 are inserted in the ferrule 27 so that the direction of pull of the cable 15 on the ferrule 27 will be in the axis X to prevent skewing of the support plate 18. It is seen in the ferrules 24 and 27 of FIG. 2A that the internal tapered bores have the small ends in alignment on the axis X so that the cable tension load will be picked up in the plates 17 and 18 and passed into the anchor bolts 19 and 28 through the sockets 22 and 32.

Figure 3:
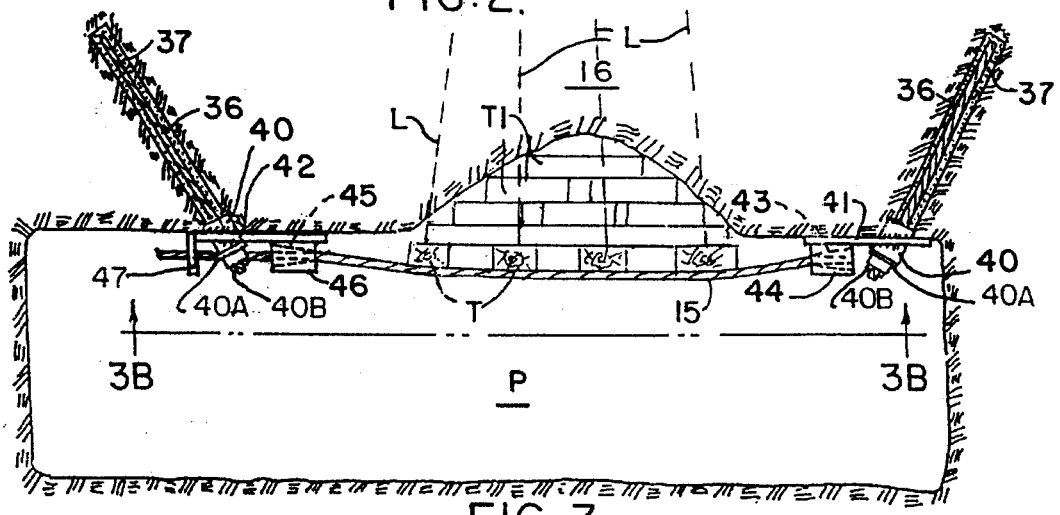
FIG. 3 is an alternate arrangement of a truss system for a situation where cribbing is needed and where cable anchors are shown according to the invention.

In the view of FIG. 3, the cable truss is shown where a number of side-by-side cables 15 are employed to carry shoring forming a cribbing assembly in which a first set of shoring elements T are set in place to exert a thrust perpendicular to the curvature of cable 15, and cross elements T-1 are stacked on top and are selectively chosen to provide a pyramid formation or stack engaged against the rock structure to provide support and stability to the same. In this arrangement the cribbing assembly acts to focus support for the geologic structure in a direction to develop support in a converging direction along lines L.. In proceeding with a support of this character the support vectors are exerted in the geologic structure from the cable truss point to a central location.

Figure 2B:
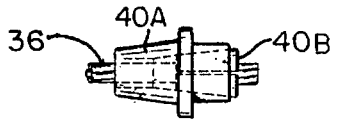
FIG. 2B is a fragmentary view of a cable anchor and wedges which are a substitute for the anchor bolts seen in FIG. 1.
Figure 3A:
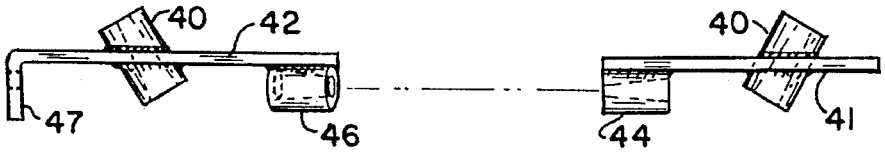
FIG. 3A is a side elevation of anchor plates seen in FIG. 3B.
Figure 3B:
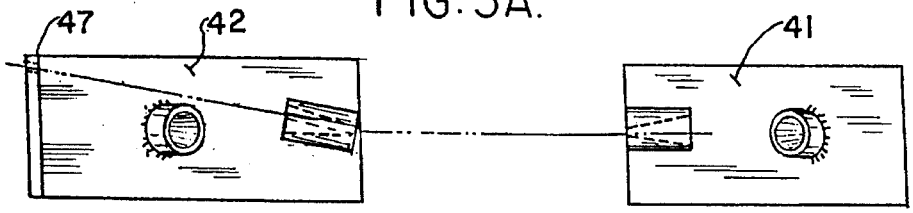
FIG. 3B is a plan view of the anchor plate detail seen in FIG. 3 along line 3B—3B.

FIGS. 3, 3A and 3B illustrate certain details of the invention in which cable anchors 36 secured by grout or settable resin material 37 in boreholes 38 have the exposed ends of the anchors secured by tapered wedges in the bores in sockets 40 (see FIGS. 3A and 3B) carried by support plates 41 and 42. The installation seen in FIG. 3 employs the flexible cable 15 of FIG. 1 with one end secured by tapered wedges 43 in the ferrule 44 on support plate 41, and by other tapered wedges 45 in the ferrule 46 on support plate 42. As before explained, the tension cable 15 is installed in the support plates 41 and 42 by being secured at one end by wedges in ferrule 44, and by wedges in the ferrule 46 on support plate 42 after a tensioning jack has exerted a pull on the opposite end of the cable 15 at the jacking bracket 47. A variation of cable anchor attachment is seen in FIG. 2B, where the outer end of a cable anchor 36 extends through the socket 40 (see FIG. 3A) and tapered body 40A is fitted in the socket 40 to receive wedge means 40B to grip the cable anchor 36.

Figure 4:
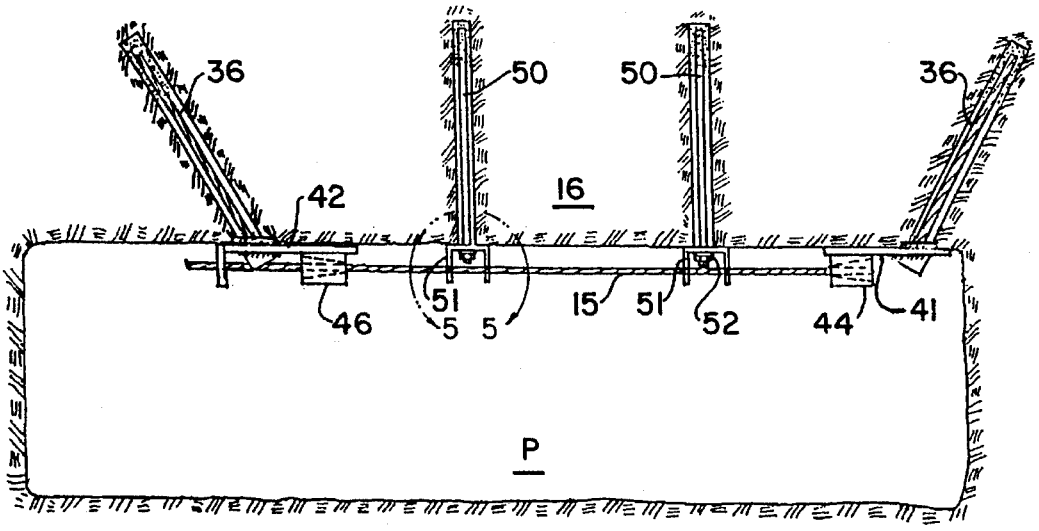
FIG. 4 is a further alternate arrangement of a drift truss system having anchor supports according to the invention.
Figure 5:
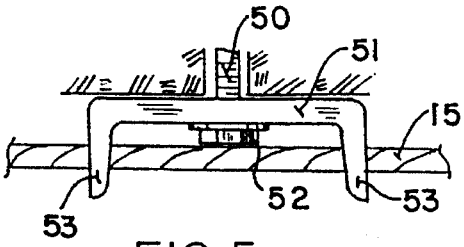
FIG. 5 is a fragmentary detail of a secondary truss cable support taken at area 5—5 in FIG. 4.
Figure 5A:
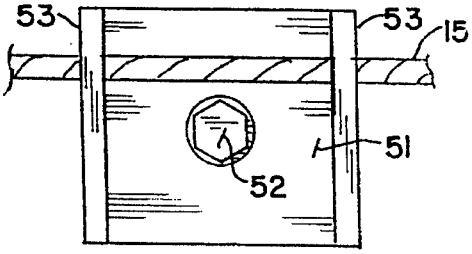
FIG. 5A is a plan view of the cable support seen in FIG. 5.

In the view of FIG. 4 the cable truss system employs support plates of the character seen in FIG. 3A at 41 and 42. These plates 41 and 42 are held against the surface of the geologic structure by suitable anchor cables 36 in the boreholes and anchored by grout or settable resin. The cable truss 15 is anchored in ferrules 44 and 46 as before explained in FIG. 3, first applying a tension load in the cable 15. FIG. 4 differs from FIG. 3 in that the cable 15 is supported by intermediate bolts 50 secured in boreholes with protruding ends engaged in support plates 51 and secured to the bolts 50 by nuts 52. Each support plate 51 (see FIGS. 5 and 5A) is formed with flanges 53 which are apertured to allow the cable 15 to slide through and also be offset to avoid interferring with the nut 52. The installation of FIG. 4 is useful when long spans of cable 15 are required, or the geologic structure seems to require the supplemental support afforded by plates 51 at selected locations along the roof of the passage P while allowing the cable 15 to slide without restraint.

Figure 10:
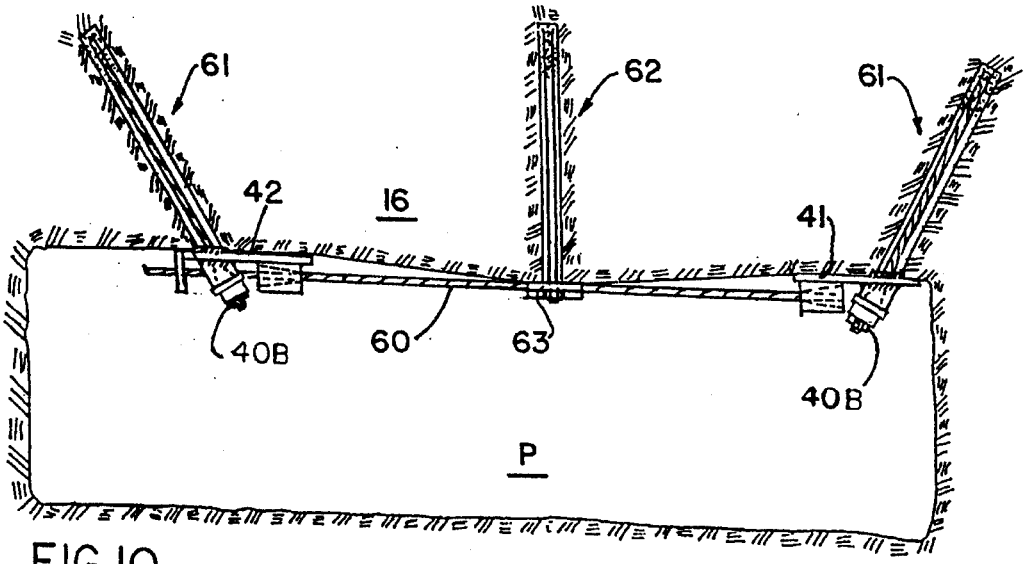
FIG. 10 is a tensioned truss cable fixture having an intermediate anchor engaged by the tension cable between anchor plates in accordance with the invention.
Figure 11:
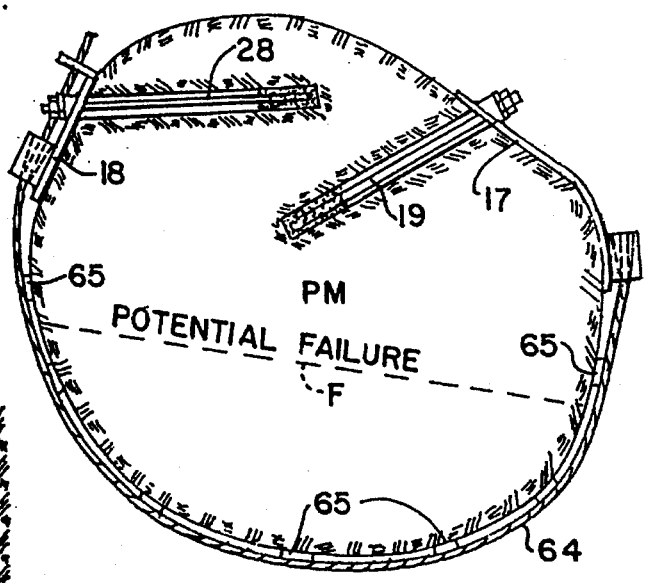
FIG. 11 is a truss system for stabilizing irregular surfaces of pillars or brows to restrain potential failures.
Figure 12:
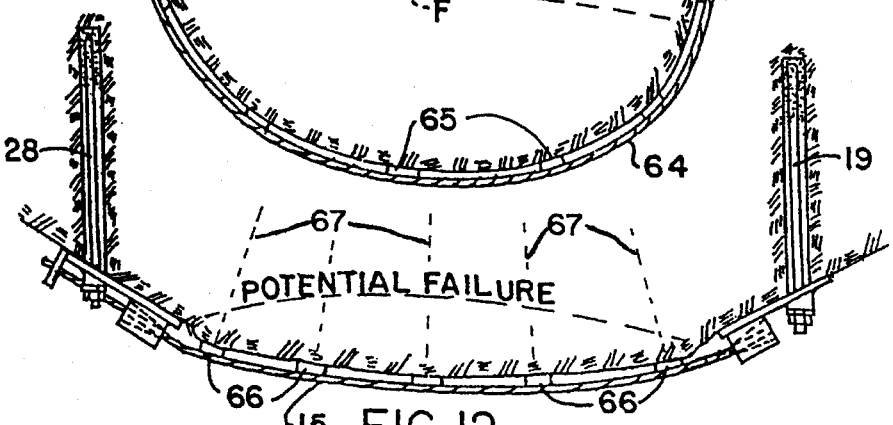
FIG. 12 is an illustration of a potential failure or collapse in the geologic mass carried in a cable truss system.

It is noted in FIG. 1 that rock anchor bolts 19 and 28 employ resinous anchor material 21 and 30 at the back of the boreholes. In FIG. 3 cable anchors 36 are shown with resinous anchor material 37 inserted full length. In FIG. 4, the cable anchors 36 have resinous material at the back of the boreholes, while rock anchor bolts 50 employ material at the back of the boreholes. Similar rock cable or bolt anchors are seen in FIGS. 10, 11, and 12. It is the intent that either type of bolt or cable anchor may be used, and either full length resinous material, or point anchor material at the back of the boreholes may be selected as found expedient.

Figure 6:
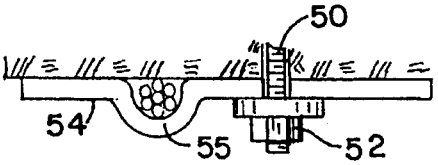
FIG. 6 is an alternate truss cable support seen in fragmentary section.
Figure 7:
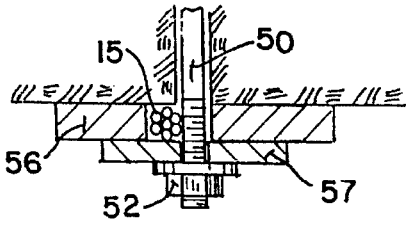
FIG. 7 is a fragmentary section detail of a further alternate cable support.

In place of the plates 51, a stamped type plate 54 of FIG. 6 may be employed so the cable 15 can slide while being enclosed by the embossed formation 55. A further character of support can take the form seen in FIG. 7 which is a stack of plates 56 and 57 in which plate 56 is divided to allow for a slidable cable located in a cable slot, and the slot is covered by the plate 57 to retain the cable 15.

Figure 8:
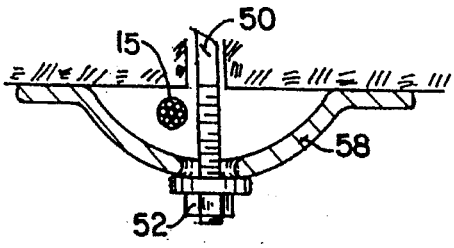
FIG. 8 is an alternate truss cable support with an embossed fixture.
Figure 9:
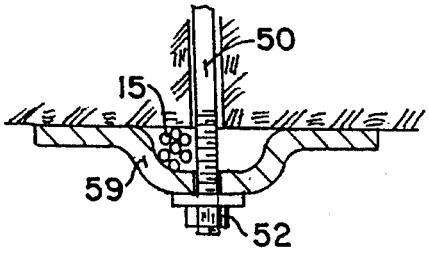
FIG. 9 is a modified embossed cable support fixture.

Furthermore, FIG. 8 illustrates an embossed type of support plate 58 which may be employed. FIG. 9 is a variation of an embossed support plate 59 if desired. These supports allow sliding adjustments of the cable 15.

FIG. 10 illustrates a modified installation of a cable tension truss 60 for the passage P in the geologic structure 16. A tensionable cable 60 is installed with primary cable anchors 61 secured in the support plates 41 and 42 by fittings of the character seen in FIG. 3. An intermediate anchor bolt 62 is located between the primary anchors 61. FIG. 11 illustrates the versitility of the invention wherein tensioned cables between support plates 17/18 may be secured to a wall by the placement of additional one or more rock fixture stud plates 65 to provide additional cable reinforcement. Mesh or mats may be placed between the cables and wall previous to rock fixture placement. Rock fixtures may be of a variety of types, for example cable bolts, grouted rebars, or post tensioned rebars.

The uniqueness of the cable truss system is illustrated in FIG. 11 where a pillar mass PM in the geologic structure may offer a threat of fracture due to load shift or other causes. A fracture may occur along the line F but by installing a wrap around cable 64 the potential fracture can be contained. In this case the support plates shown at 17 and 18 in FIGS. 2 and 2A can be employed with anchor rods 19 and 29 placed in the pillar mass and tensioned up to a desired load, along with a system of spaced load bearing blocks 65.

In FIG. 12 there is illustrated an additional application of the cable truss system which is installed to support and prevent potential failure along the geologic mass between placement of anchor bolts 19 and 28 of the type seen in FIG. 1 along with the assistance of wedges 66. When a support situation is called for to contain a potential failure in the geologic structure, the cable truss system of several cables 15 can be combined with shoring members 66 which are spaced in a manner to exert a thrust on the geologic structure which is generally perpendicular to the cable 15. Thus, the cable 15 approaches a parabolic or semi-parabolic curvature which places the several shoring members under a load having a specific thrust reaction that tends to focus support toward a central areas in the geologic structure, as is indicated by the broken thrust lines 67.

Figure 13:
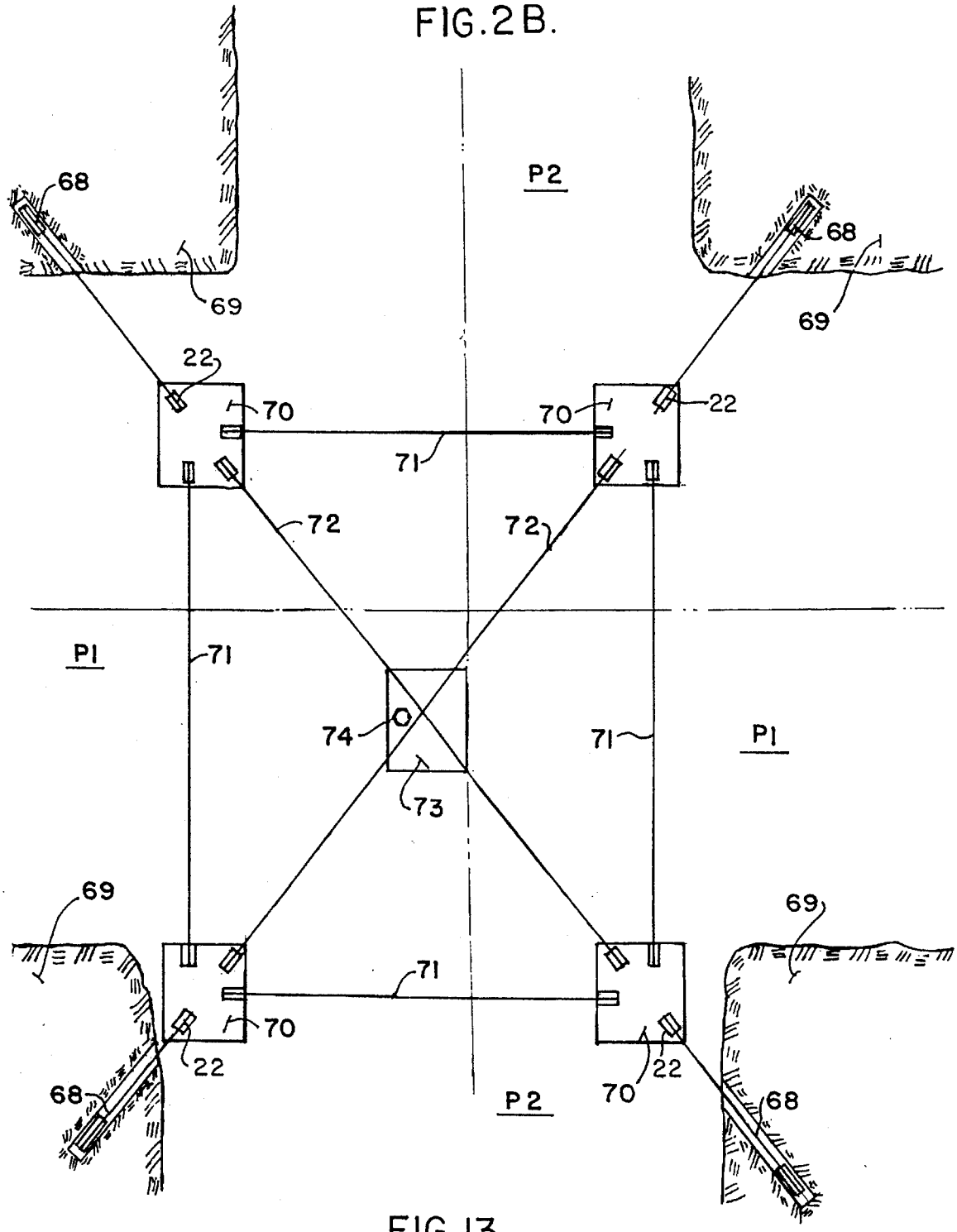
FIG. 13 is an illustration of a four way intersection support system using a plurality of cable anchor plates according to the invention.

In FIG. 13 there is illustrated, in schematic form, a cable truss system installed in the area where drifts or passages P-1 and P-2 intersect to form an enlarged open area that needs overhead support. Thus, the truss system involves installing anchors 68 in each of the corner pillars 69 so that the protruding ends can be secured in plates 70 that are held against the ceiling adjacent the corners 69. The respective plates 70 are formed with angularly directed sockets 22 such as are shown in FIG. 2A where the anchors 68 are rods, or sockets 40 as shown in FIG. 3A when anchor cables are employed. Furthermore each plate 70 is provided with ferrules of either type 24 and 27 seen in FIG. 2A or type 44 and 46 seen in FIG. 3A so that the respective plates are able to accommodate rectilinear cables 71 as well as diagonally directed cables 72. The cables 72 cross over each other near the center of the truss system, and a support plate 73 is installed at that crossing point by a suitable anchor, the end of which is seen at 74. Plate 73 is used to support the cables 72 while imposing no restraint on the tension to be applied.

The method of installing the cable system of FIG. 13 is generally to install the diagonal cables 72 first so that the plates 70 can be located and initial tension loads can be applied with the use of the power jack J as explained in connection with FIG. 1. Thereafter, the rectilinear cables 71 can be installed and tension loads can be progressively applied until the cable system is tensioned as desired.

Figure 14:
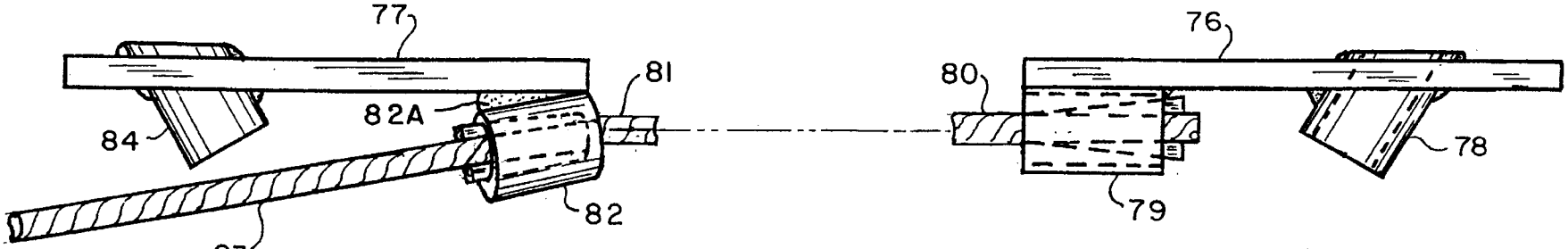
FIG. 14 is a side elevation of a modified anchor plate detail of a truss system.
Figure 15:
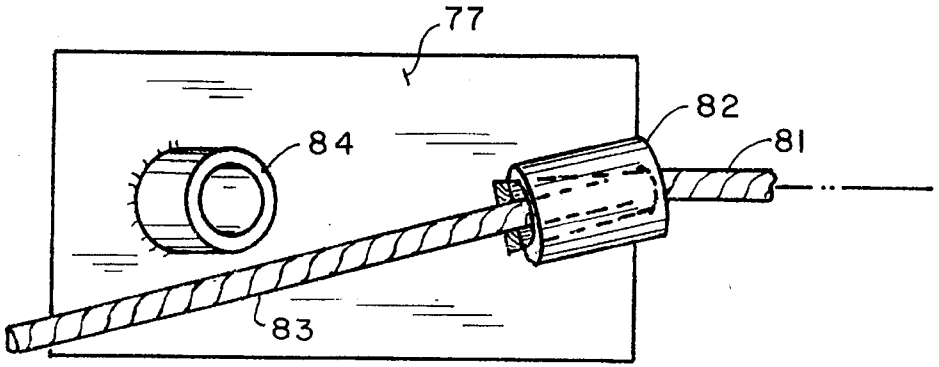
FIG. 15 is a plan view of one of the support plates seen in FIG. 14.

Turning now to FIGS. 14 and 15 there is shown a cable truss system according to the invention for the cooperative interconnection between support plates 76 and 77 which are intended to be flexible to conform to the geologic surface in a manner similar to the suggestion applicable to support plates 17 and 18 shown in FIG. 1. The cooperation between support plates 76 and 77 is obtained by providing the plate 76 with the usual socket 78 for the geologic anchor, and there is also a ferrule 79 which is secured to the plate 76 in position to receive one end 80 of a cable 81 which extends to a suitable distance so that it can be secured in a ferrule 82 mounted on the support plate 77 so as to direct the terminal end 83 of the cable 81 so that it angularly bypasses a socket 84 on the plate 77. The feature of the system shown in FIG. 14 is that the ferrule 82 is secured by welding at 82A to the support plate 77 so that its longitudinal axis is angularly directed relative to the plane of the plate 77 so as to direct the cable 83 in a direction to pass above the socket 84, and the ferrule 82 is also turned, as in FIG. 15, so that its axis steers the cable end 83 to pass to one side of the socket 84. In a cable installation of the general character shown in FIG. 1, for example, it is desirable to install the cable 81 so that a tension load may be imposed by utilizing the cable jack device and its associated power unit to exert a predetermined pull on the cable end 83 to impose the desired tension load. The cable jack device and the power unit are both illustrated in FIG. 1, and it is easily understood that this equipment can be utilized to preload the cable system illustrated in FIGS. 14 and 15 without any interference from the socket 84 on the support plate 77. An additional advantage of the disclosures in FIGS. 14 and 15 is that the support strut 34 of FIGS. 2 and 2A can be eliminated, thereby a greater load can be exerted on the cable 81 that would not necessarily be sustained by the strut 34 shown on the plate 18 in FIGS. 2 and 2A.

Figure 16:
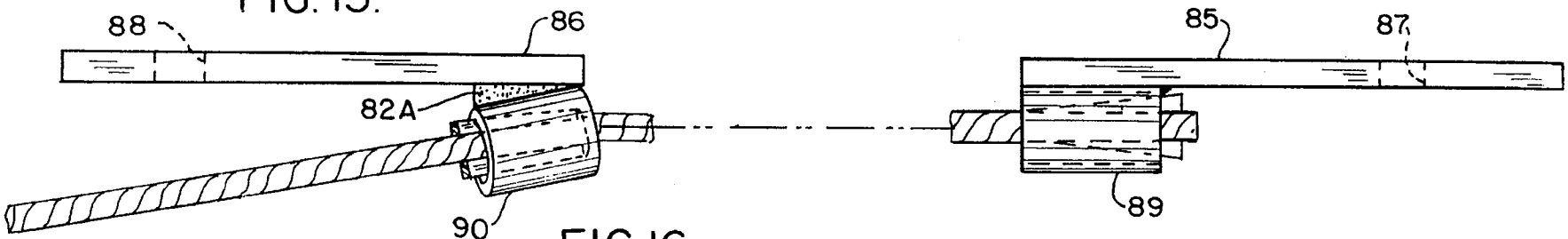
FIG. 16 is a side elevation of a further modified anchor plate detail.

In manufacturing the components for the cable truss system, it is more economical, without detracting from the effectiveness of the system, to form support plates 85 and 86 (see FIG. 16) with plain apertures 87 and 88 respectively for the attachment of the geologic cable or anchor bolts which act to retain the plates in position. In addition, plate 85 supports a ferrule 89 in welded position to secure one end of a usual cable of the character shown in FIG. 14. The cooperating support plate 86 carries an angularly aligned ferrule 90 having the position similar to the ferrule seen in FIGS. 14 and 15.

Figure 17:
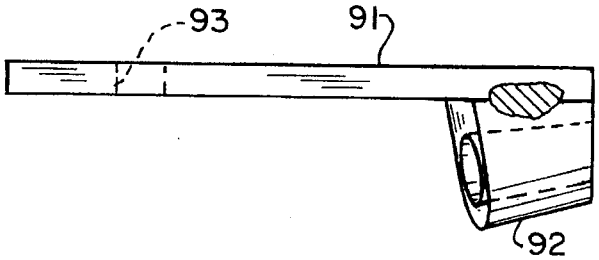
FIG. 17 is a side elevation of an anchor plate casting which would be typically applicable to a companion anchor plate.

Further economics can be practiced in the manufacture of the support plates by resorting to casting the plates and the ferrule carried thereby. An example is seen in FIG. 17 where the plate 91 and a ferrule 92 are formed in a casting process which also provides the aperture 93 for the anchor means. The support plate which is companion to the plate 91 in FIG. 17 is not shown since its cast configuration is well understood.

Figure 19:
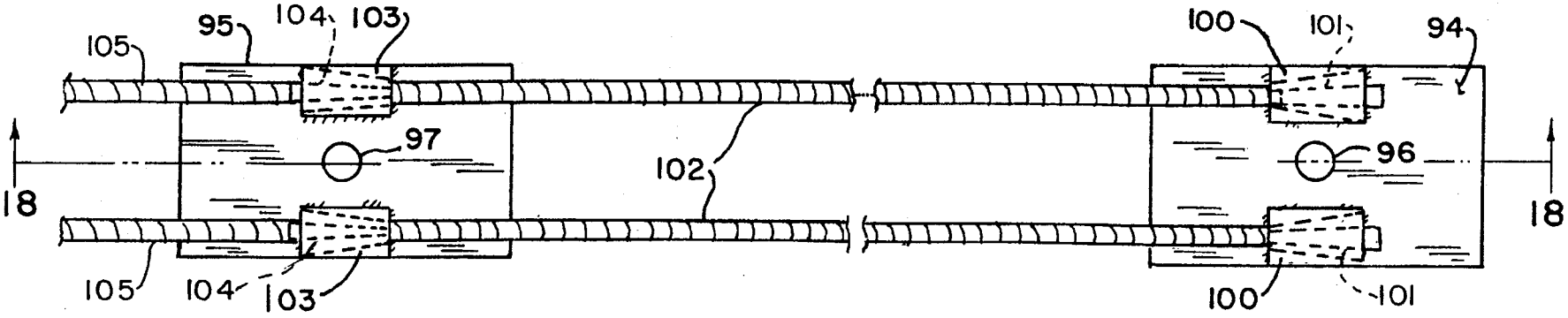
FIG. 19 is a plan view of the cable detail seen in FIG. 18.
Figure 18:
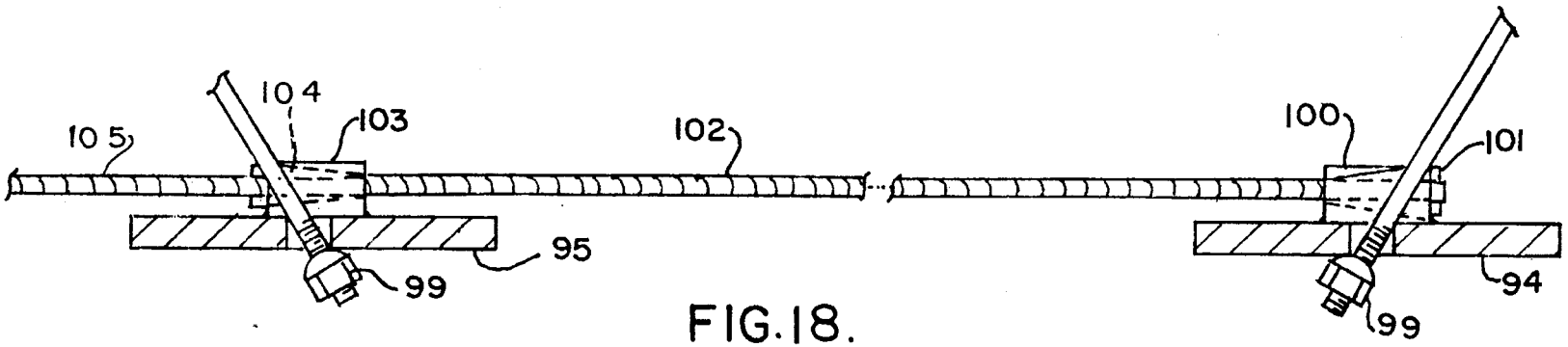
FIG. 18 is a side elevation of still another plate and cable detail for a drift truss system.

Still another cable truss system is seen in FIGS. 18 and 19 to illustrate the installation of support plates 94 and 95 having plane apertures 96 and 97 respectively for the attachment of the plates to the anchor bolts 98 by a spherical surface nut 99 which seats in the respective apertures 96 and 97. The plate 94 is provided with dual ferrule bodies 100 having tapered bores to receive wedges 101 for securing the ends of a dual system of tension cables 102. The opposite plate 95 also has dual ferrules 103 providing tapered bores to receive wedges 104 after the jacking device J (see FIG. 1) has exerted a required tension on each of the cable ends 105 which pass through the ferrules 103 to be locked in the tapered bores by wedges 104. It is understood that the jacking device J will react upon the ferrules 103 as a surface to push against.

It may now be appreciated from the foregoing description in what manner a cable truss system can be installed to provide support for geologic structure that has been disturbed by the formation of an underground drift. Whether the cable truss embodies a series of single cables stretched across a drift or multiple cables across a drift, the essential components comprise the mounting of support plates against the surface of the geologic structure by anchor cables or bolts secured in bore holes driven into the geologic structure to establish anchorage for ends exposed in the drift for attachment to the support plates, thereby establishing the position of the support plates for the installation of one or more truss cables which establish the stability of the drift.

Having set forth certain details of the invention, it is understood that a reasonable degree of scope is to be protected by the essence of the invention in underground support systems and methods of support which fall within the range of structural details which are applied to the method herein described. The invention resides in an underground geologic structure which supports such structure to guard against collapse or failures in the geologic structure to maintain integrity of existence after some of the structure has been removed. The method here is to employ a staged support in which anchor bolts or cables are put into place in suitable boreholes to provide a first stage of support. The first stage supports are combined with a cable truss system which connects into the first stage supports to provide a more secure support, especially in connection with long spans of openings or drifts in mine passages. The system is such that great flexibility can be achieved in a relatively simple structure consisting of cooperating first and second stages of support that can be applied to mine passage ceilings, sidewalls and pillars that are left to bear a certain load which naturally occurs when geologic structure is disturbed in a mining or other operation.

What is claimed is:

1. A construction for staged underground supporting of geologic structures exposed within the formation of passages in such geologic structure, the supporting construction comprising:

a) spaced apart anchor means inserted into the geologic structure and having end portions exposed in the passage;

b) support means connected to each of the exposed end portion of the spaced apart anchor means to engage the geologic structure and supply a first stage of support through said support means; and c) flexible cable means to supply a second stage of support for the geologic structure, said flexible cable means having one end secured to one of said spaced apart anchor means and having an opposite end adjustably connected to the other one of said spaced apart anchor means, the adjustable connection to said other one of said anchor means enabling varying the tension in said cable means.

2. An underground mine cable truss for supporting geologic structure and including in combination:

a) a pair of support plates spaced apart and presenting surfaces bearing on the mine geologic structure, each of said support plates having a socket means thereon positioned with a bore facing the geologic structure and each support plate having ferrule means thereon, each ferrule means being formed with a bore directed toward a socket means, and said bore in each of said ferrule means being tapered;

b) anchor bolt means secured in the geologic structure and having end portions fixed in said socket means on said support plates to retain said support plates bearing on the mine geologic structure;

c) a cable jacking abutment carried on one of said support plates spaced from said ferrule on that support plate, and d) elongated cable means having a first end anchored in said tapered bore in one of said ferrule means on one of said pair of support plates, and said cable means having a second end directed through said tapered bore in said second one of said ferrule means and directed into alignment with said cable jacking abutment, said second one of said ferrule means allowing adjustment of the tension load in said cable means.

* * * * *